United States Patent [19]

Seragnoli

[11] 4,367,758

[45] Jan. 11, 1983

[54] CIGARETTE MANUFACTURING MACHINE OF THE CONTINUOUS ROD TYPE

[75] Inventor: Enzo Seragnoli, Bologna, Italy

[73] Assignee: G.D Societa per Azioni, Italy

[21] Appl. No.: 204,343

[22] Filed: Nov. 5, 1980

[30] Foreign Application Priority Data

Nov. 16, 1979 [IT] Italy ..... 50840 A/79

[51] Int. Cl.[3] ..... A24C 5/18; A24C 5/31

[52] U.S. Cl. ..... 131/84 B

[58] Field of Search ..... 131/84 B, 84 A, 84 R, 131/84 C

[56] References Cited

U.S. PATENT DOCUMENTS 3,736,941 6/1973 Molins et al. ..... 131/84 B

FOREIGN PATENT DOCUMENTS 1137444 12/1968 United Kingdom ..... 131/84 B

*Primary Examiner*—V. Millin

*Attorney, Agent, or Firm*—Merriam, Marshall & Bicknell

[57] ABSTRACT

A cigarette manufacturing machine of the continuous rod type in which a stream of tobacco particles flows upwardly through a vertical duct and feeds a conveyor system to form a tobacco layer or filler and feed it to a continuous cigarette rod forming apparatus. The conveyor system includes an air-permeable mobile belt which spans the duct outlet and extends to the cigarette rod forming apparatus. During its formation and transfer, the tobacco layer is retained on the belt by suction applied to the belt face opposite the face holding the filler. The suction is divided with first suction apparatus operating on the belt portion disposed over the duct outlet, and with second suction apparatus, independent of the first, operating on the belt portion between the duct edge and the cigarette rod forming apparatus.

3 Claims, 1 Drawing Figure

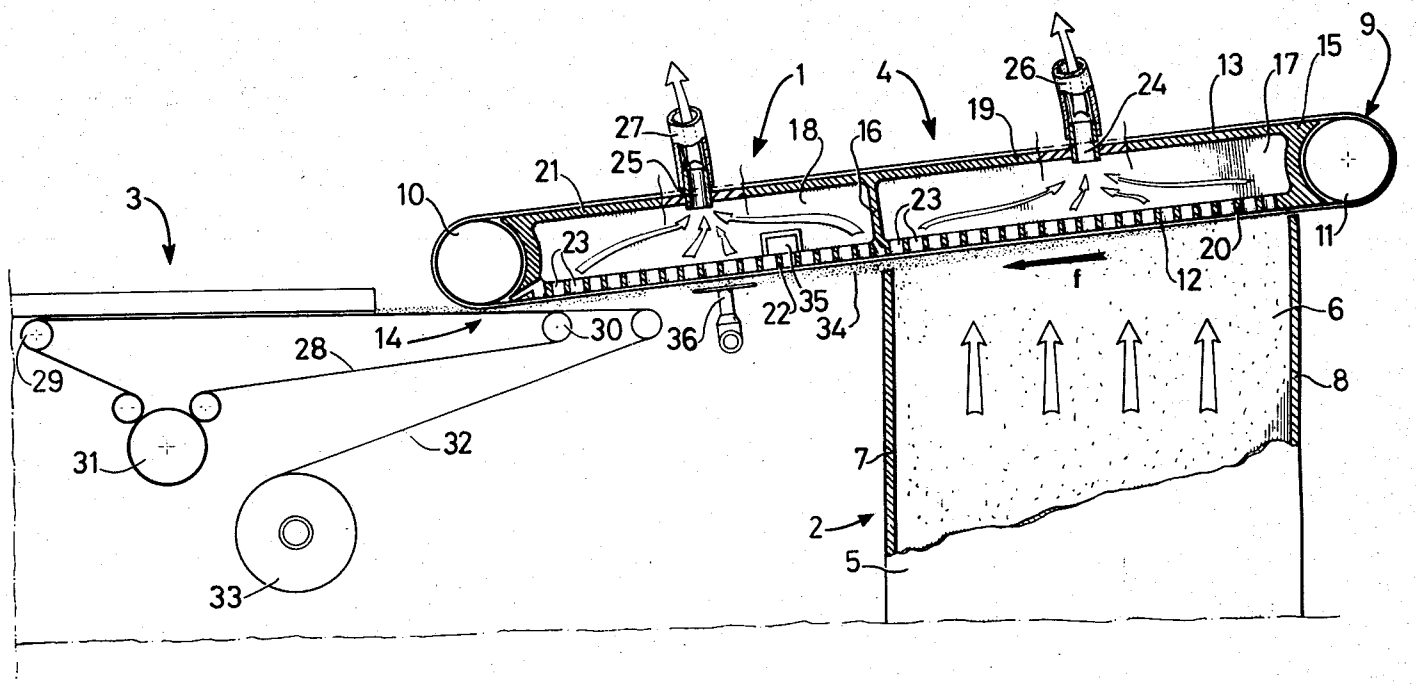
9
15
17
13
24
26
19
4
16
18
1
27
25
21
10
11
6
8
20
12
f
23
34
35
22
36
30
14
28
3
29
31
33
32
7
2
5

CIGARETTE MANUFACTURING MACHINE OF THE CONTINUOUS ROD TYPE

BACKGROUND OF THE INVENTION

This invention relates to a cigarette manufacturing machine of the continuous rod type, and more particularly to a conveyor system designed to form a continuous tobacco layer or filler, and to feed it to the formation means for the so-called continuous cigarette rod.

Cigarette manufacturing machines of the aforesaid type are known, which comprise a substantially vertical duct fed at its lower end by a continuous stream of tobacco particles and closed upperly by the lower branch of an air-permeable conveyor belt in the form of an endless loop passing around end rollers.

Within the loop described by said belt there is provided a chamber connected to a suction source and bounded lowerly by a wall traversed by holes or slots.

The lower branch of the conveyor, which slides in proximity to said wall, extends in the direction of its motion beyond the vertical duct outlet as far as a position, defined as the discharge position, at which it meets the feed track for a cigarette paper web.

Under the thrust of a rising air stream, the tobacco particles rise up the vertical duct and, under the effect of the suction exerted by said chamber through the perforated wall and the air-permeable belt, adhere to said branch to accumulate thereon and form a substantially uniform layer or filler of tobacco particles. This filler, which is retained by the conveyor belt by suction, is transferred from the vertical duct outlet to said discharge position, in which it is deposited on the cigarette paper web.

The paper web is then progressively closed about the tobacco filler in order to form the so-called continuous cigarette rod.

The individual cigarettes are finally obtained from this rod by a cutting operation.

In known manner, during its passage over the path between the vertical duct and discharge position, the tobacco filler is subjected to operations the purpose of which is to increase its level of uniformity.

Its air-permeability is firstly measured by means of a control device comprising suction means.

Downstream of said control device, and controlled by it, there is provided the so-called trimmer device.

Its purpose is to reduce the transverse dimensions of the tobacco filler and at the same time to eliminate any variations in its thickness by removing a quantity of tobacco which depends on the permeability variations detected by the control device.

In such manufacturing machines of known type, the tobacco layer or filler is properly compact and perfectly adheres to the conveyor belt over that portion of the path at the vertical duct outlet. In contrast, over that portion of the path between the vertical duct and the discharge position, there is an obvious relaxing of the tobacco filler and a reduction in its adherence to the conveyor belt.

This situation is due mainly to the fact that at the vertical duct outlet, the action of the rising air stream which feeds the tobacco is added to the suction exerted on the filler by said chamber, whereas over that portion of the path outside the duct, the tobacco filler is subjected only to the suction action of said chamber.

The consequence of this is that the tobacco particles can separate from the conveyor belt.

Moreover, because of its relaxation and poor adhesion to the conveyor belt, the tobacco filler when external to the vertical duct is not in a suitable state for subjection to the air permeability control device and scraper device.

SUMMARY OF THE INVENTION

The object of the present invention is to provide a conveyor transfer system for the tobacco filler which is able to obviate the aforesaid drawbacks, i.e. which is able to ensure that the tobacco filler is also compact and adheres to the conveyor belt over that portion of the path external to the vertical duct.

These and further objects are all attained by the cigarette manufacturing machine of the continuous rod type comprising a substantially vertical duct for feeding a continuous stream of tobacco particles from the bottom upwards, a conveyor system for forming and transferring a layer or filler of tobacco particles comprising an air-permeable conveyor belt in the form of an endless loop disposed to close the upper end or outlet of said duct and extending in the direction of its motion substantially in a straight-line path as far as a position, known as the discharge position, at which it meets the feed track of a cigarette paper web, and suction means arranged to retain said filler on said belt and applied to that face of said belt opposite the one holding said filler and acting transversely to the direction of movement of said belt, said conveyor system being characterised in that said suction means are divided into first suction means operating over a first portion of said belt disposed at the outlet of said duct, and second suction means, independent of the first, operating over a second portion of said belt between said duct and said discharge position.

BRIEF DESCRIPTION OF THE DRAWING

Further characteristics and advantages will be more apparent from the detailed description given hereinafter of the manufacturing machine according to the present invention, illustrated by way of non-limiting example in the single accompanying drawing which shows a partly sectional front view of said machine.

DETAILED DESCRIPTION OF THE INVENTION

In said FIGURE, the reference numeral 1 indicates overall a cigarette manufacturing machine of the continuous rod type. The machine 1 is divided into two parts, namely a substantially vertical duct indicated by 2, and a section indicated overall by 3 for forming a continuous cigarette rod, and then for producing individual cigarettes by a cutting operation.

The duct 2 and section 3 are connected to each other by a conveyor system indicated overall by 4 and which lies above them.

The duct 2 has a rectangular cross-section and is defined at its front and rear, with reference to the figure, by two walls 5 and 6, and laterally on its left and right by two walls 7 and 8.

The conveyor system 4 comprises an air-permeable conveyor belt 9 and suction means described in detail hereinafter.

The belt 9 is endless about two equal end rollers, indicated from left to right by 10 and 11 and rotating in a clockwise direction about axes normal to the walls 5 and 6.

Said rollers 10 and 11 are disposed with the latter at a higher level than the former, so that the lower branch 12 and upper branch 13 of the belt 9 are inclined upwards from left to right.

The lower branch 12 closes the outlet of the duct 2 and its left hand end extends as far as a position 14, defined as the unloading position, at which tobacco is fed to the section 3.

The lower branch 12 and upper branch 13 run along the perimeter of a box member 15 divided by a baffle 16 into two chambers 17 and 18.

The chamber 17 lies above the duct 2 and is bounded upperly by a wall 19 and lowerly by a wall 20.

The chamber 18, which lies above the section 3 in the zone between the wall 7 and discharge position 14, is bounded upperly by a wall 21 and lowerly by a wall 22.

The two walls 20 aand 22 in contact with the branch 12 are traversed by holes or slots 23, while the upper walls 19 and 21 in contact with the branch 13 are provided respectively with an aperture 24 and an aperture 25 which constitute the outlets of conduits 26, 27 connected to two suction sources, not shown.

From the description, the suction means for the conveyor 4 are divided into first suction means operating over the outlet of the duct 2, and second suction means, independent of the first, operating between the duct 2 and discharge position 14.

The discharge position 14 is located where said branch 12 meets the upper horizontal branch of a belt 28 which is endlessly disposed about two end rollers 29 and 30 and driven by a roller 31 rotating in an anticlockwise direction.

The reference numeral 32 indicates a cigarette paper web which is unwound from a spool 33, and becomes superposed on the belt 28 immediately upstream of said discharge position 14.

When the machine 1 is operating, means of known type, not shown, feed the lower end of the duct 2 with a continuous stream of tobacco particles.

Under the thrust of a rising air stream generated by a compressed air source, not shown, these particles rise up the duct 2 until they encounter the branch 12 of the air-permeable belt 9.

Under the action of said first suction means, i.e. under the suction force transmitted by the chamber 17 through the holes 29 of the wall 20 to the belt 9, the tobacco particles adhere to the branch 12 which moves in the direction of the arrow f, and accumulate on each other to form a layer or filler of substantially uniform thickness.

After passing the lateral wall 7, i.e. when outside the duct 2 and downstream of the baffle 16, the tobacco filler indicated by 34 is retained on the branch 12 by said second suction means, i.e. by the suction force transmitted to the belt 9 by the second chamber 18 through the holes 23 in the wall 22.

The suction force of the chamber 18 is adjusted to compensate for the absence over that portion between the wall 7 and the discharge position 14, of the rising air current which flows through the duct 2. This eliminates the reason for the relaxation of the filler 34, the separation of tobacco particles from it, and its poor adherence to the belt 9.

Downstream of the wall 7, the tobacco filler 34, in a perfect state of compactness and adherence to the branch 12, is firstly subjected to the air permeability checking operation by a device 35, then to trimming by a trimmer device 36, and is finally deposited on the paper web 32 in the discharge position 14, where the branch 12 abandons the wall 22.

The filler 34 is then wrapped by the paper web 32 in known manner by means not shown on the figure.

The result of this operation is the formation of the so-called cigarette rod, from which the individual cigarettes are obtained by a cutting operation.

What I claim is:

1. A cigarette manufacturing machine of the continuous rod type comprising a substantially vertical duct for feeding a continuous stream of tobacco particles from the bottom upwards, a conveyor system for forming and transferring a layer or filler of tobacco particles comprising an air-permeable conveyor belt in the form of an endless loop disposed to close the upper end or outlet of said duct and extending in the direction of its motion substantially in a straight-line path as far as a position, known as the discharge position, at which it meets the feed track of a cigarette paper web, first independent suction means arranged to retain said filler on said belt and applied to that face of said belt opposite the one holding said filler and acting transversely to the direction of movement of said belt, said conveyor system being characterised in that said suction means are divided into first suction means operating over a first portion of said belt disposed at the outlet of said duct, and second suction means, independent of the first, operating over a second portion of said belt between said duct and said discharge position whereby the second independent suction means applies a suction force so as to compensate for the loss of force exerted by said rising air current which communicates with said first independent suction means.

2. A manufacturing machine as claimed in claim 1, characterised in that said first suction means comprise a chamber internal to said loop and connected to a suction source and communicating with the outside at said first portion of belt, and said second suction means comprise a chamber internal to said loop and connected to a suction source and communicating with the outside at said second portion of belt.

3. A manufacturing machine as claimed in claims 1, characterised in that said suction means comprise a box member divided into said two chambers by means of a baffle.

* * * * *